US010737814B2

(12) United States Patent
Vaughn

(10) Patent No.: US 10,737,814 B2
(45) Date of Patent: Aug. 11, 2020

(54) WIRE RELEASE MECHANISM

(71) Applicant: Accent Packaging, Inc., Tomball, TX (US)

(72) Inventor: Mark Vaughn, Wyandotte, OK (US)

(73) Assignee: Accent Wire Holdings LLC, Tomball, TX (US)

( * ) Notice: Subject to any disclaimer, the term of this patent is extended or adjusted under 35 U.S.C. 154(b) by 638 days.

(21) Appl. No.: 15/479,362

(22) Filed: Apr. 5, 2017

(65) Prior Publication Data

US 2017/0320604 A1 Nov. 9, 2017

Related U.S. Application Data

(60) Provisional application No. 62/319,139, filed on Apr. 6, 2016.

(51) Int. Cl.

| | |
|---|---|
| ***B65B 13/00*** | (2006.01) |
| ***B65B 13/22*** | (2006.01) |
| ***B65B 13/18*** | (2006.01) |
| ***B65B 13/26*** | (2006.01) |
| ***B65B 13/02*** | (2006.01) |
| *B65B 27/12* | (2006.01) |

(52) U.S. Cl.

CPC ..... *B65B 13/22* (2013.01); *B65B 13/02* (2013.01); *B65B 13/185* (2013.01); *B65B 13/26* (2013.01); *B65B 27/12* (2013.01)

(58) Field of Classification Search

CPC ..... B65B 13/02; B65B 13/18; B65B 13/185; B65B 13/22; B65B 13/24; B65B 13/28; B65B 13/30; B65B 13/305; B25B 25/00

See application file for complete search history.

(56) References Cited

U.S. PATENT DOCUMENTS

| | | | | |
|---|---|---|---|---|
| 1,939,746 | A * | 12/1933 | Whitman | B65B 13/285 254/213 |
| 8,397,632 | B2 | 3/2013 | Millett et al. | |
| 8,757,055 | B2 | 6/2014 | Millett et al. | |
| 9,045,245 | B2 | 6/2015 | Giett | |
| 2013/0247515 | A1* | 9/2013 | Actis | B65B 13/02 53/399 |
| 2015/0066214 | A1 | 3/2015 | Vaughn | |
| 2015/0251788 | A1* | 9/2015 | Vaughn | B65B 13/185 100/33 R |

* cited by examiner

*Primary Examiner* — Debra M Sullivan
(74) *Attorney, Agent, or Firm* — Ira Domnitz

(57) ABSTRACT

A wire release mechanism for securing an end of a wire during a wire tying cycle is provided. The wire release mechanism may secure a first end of a wire around a bale of recycled material during knotting of the wire. The wire release mechanism may include a wire release portion having an engaging surface and the wire release portion may be movable between an open and closed position. The wire release mechanism may further include a gripping arm movable between a first position and a second position and having a retractable surface. The engaging surface may disengage the wire based on movement from the closed position to the open position. Further, the retractable surface may engage against the first end of the wire based on movement from the first position to the second position.

14 Claims, 9 Drawing Sheets

WIRE RELEASE MECHANISM

CROSS-REFERENCE TO RELATED APPLICATIONS

This application claims priority to U.S. provisional patent application 62/319,139, filed Apr. 6, 2016, which is incorporated by reference herein in its entirety.

STATEMENT REGARDING FEDERALLY SPONSORED RESEARCH

Not applicable.

BACKGROUND OF THE INVENTION

Traditional bulk-material baling machines incorporate a tying system for wrapping and/or securing the baled material, such as a wire tying system. In forming bales of compressible materials, it is important to surround the baled material with a wire having sufficient strength to maintain the form of the compressed bale for shipping and/or storage. At the same time, the wire used to secure a bale must be adequately tensioned by the tying system, as well as securely knotted and/or tied around the bale. In some instances, a wire tying system requires one or more features to securely position at least one end of a wire during knotting/tying, which enables tensioning of the wire and tightening of the strap around the bale. However, traditional hydraulic wire release mechanisms may cause mechanical complications during tensioning of the wire, as well as add to the expense of the overall wire tying system.

SUMMARY

In some of the embodiments the present invention relates to a wire release mechanism on a strapping machine for securing at least one end of a wire applied to a baled material.

Some embodiments or the present invention introduce technology for resolving the above-mentioned issues conventionally experienced when securing a wire strap applied with a bulk-material baling system. Accordingly, some embodiments of a wire release mechanism for securing at least one end of a wire during a wire tying cycle of a wire tying assembly may include a wire release portion having an engaging surface. The wire release portion may be affixed to the wire tying assembly such that the wire release portion can move between 1) an open position where the engaging surface is disengaged from, and a first distance away from, at least one end of a wire, and 2) a closed position where the engaging surface may engage, and is a second distance away from, at least one end of a wire during the wire tying cycle. In some embodiments, the wire tying cycle comprises the steps of moving the wire release portion to the closed position, advancing a wire, gripping at least one end of a wire by pressing the wire against the engaging, surface with a retractable surface of the wire tying assembly, tying the wire, and moving the wire release portion to the open position to release at least one end of a wire.

In another embodiment, the wire release mechanism may include a wire release portion and a gripping arm. In some embodiments, the retractable surface may be included on the gripping arm. The gripping arm may be affixed to the wire tying assembly such that the gripping arm is configured to move between a first position where the retractable surface is disengaged from the wire and a second position where the retractable surface may engage the wire during the wire tying cycle. In this embodiment, the wire tying cycle comprises the steps of moving the gripping arm to the first position, moving the wire release portion to the closed position, advancing a wire, moving the gripping arm to the second position to grip at least one end of a wire by pressing the wire against the engaging surface with the retractable surface, tying the wire, and moving the wire release portion to the open position to release at least one end of a wire.

In yet another embodiment, the wire release mechanism may include the wire release portion and gripping arm, and a base. In this embodiment, the wire release portion is affixed to the base such that the wire release portion can move between the open position and the closed position during the wire tying cycle. In turn, the base is affixed to the wire tying assembly.

In some embodiments, the wire release portion may further include a first portion. In one embodiment the engaging surface is located on the first portion. In other embodiments, the first portion may include a lip projecting therefrom and away from a second portion positioned opposite the first portion. The lip may include a first wire flange guide for directing the wire past the engaging surface and may further include the engaging surface. In one embodiment, the lip includes an offset such that the first wire flange guide projects farther from the second portion than does the engaging surface. The offset may include a binding feature (e.g., a corner).

In other embodiments, a wire receiving surface may be located on the base or on the wire tying assembly. The wire receiving surface may include a wire channel that may be positioned on the wire receiving surface such that the engaging surface is located adjacent to the wire channel when the wire release portion is in the closed position. In another aspect, the lip may be positioned adjacent to the wire channel when the wire release portion is in the closed position.

In some embodiments, the wire receiving surface may also include a second wire guide flange. In this aspect, the second wire guide flange may be located opposite of, and across the wire channel from, the first wire guide flange when the wire release portion is in the closed position.

In one embodiment, the wire release portion may be hingedly affixed at the second portion to a pivot yoke. The pivot yoke may be affixed to the base, integrated within the base, and/or integrated within the wire tying assembly. In this embodiment, the gripper block may rotate around the pivot yoke from the open position to the closed position. In other embodiments, the wire tying assembly includes a rotating arm that may couple to the wire release portion and actuate the wire release portion between the closed position and the open position. In this embodiment, the rotating arm moves between a forward arm position and a rearward arm position.

In another embodiment, the gripping arm is actuated between the first position and the second position by a hydraulic arm. The hydraulic arm may be coupled to the hydraulic system of the wire tying assembly. The hydraulic arm may be supplied hydraulic fluid by a common hydraulic circuit corresponding to at least a portion of the wire tying assembly that applies a tying force to the wire. In some embodiments, the retractable surface may be located on an end of the hydraulic arm. In other embodiments, the gripping arm may be rotatably affixed to the wire tying assembly at a pin.

Additional objects, advantages, and novel features of the invention will be set forth in part in the description that follows, and in part will become apparent to those skilled in the art upon examination of the following, or may be learned by practice of the invention.

BRIEF DESCRIPTION OF SEVERAL VIEWS OF THE DRAWINGS

The present invention is described in detail below with reference to the attached drawing figures, wherein.

DETAILED DESCRIPTION OF THE INVENTION

Figure 1A:
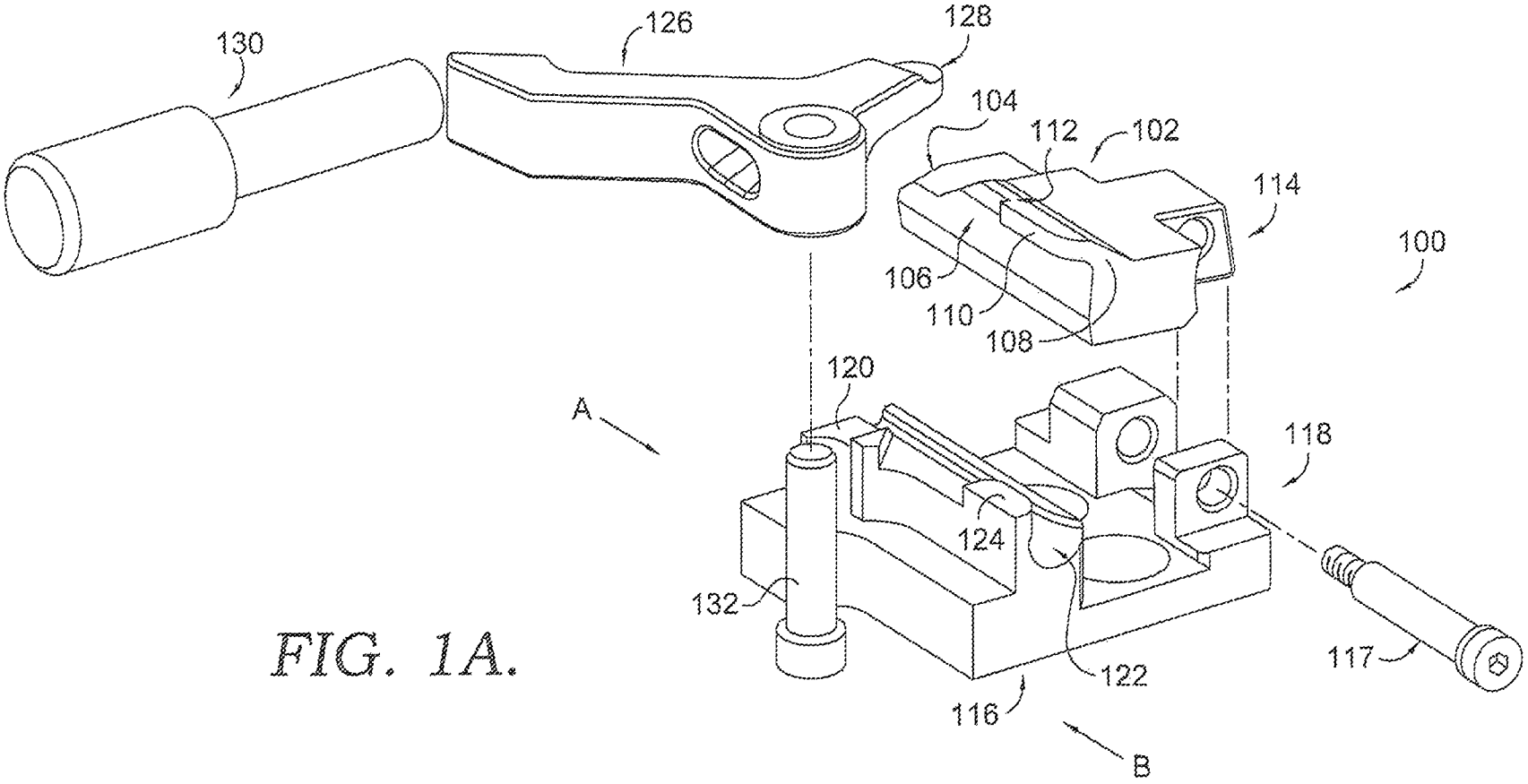
FIG. 1A is an exploded bottom view of the first end of a wire release mechanism for bulk-material baling, in accordance with an embodiment of the invention.

One or more illustrative embodiments incorporating the invention disclosed herein are presented below. Applicant has created a revolutionary wire release mechanism.

In the following description, certain details are set forth such as specific quantities, sizes, etc. so as to provide a thorough understanding of the present embodiments disclosed herein. However, it will be evident to those of ordinary skill in the art that the present disclosure may be practiced without such specific details. In many cases, details concerning such considerations and the like have been omitted inasmuch as such details are not necessary to obtain a complete understanding of the present disclosure and are within the skills of persons of ordinary skill in the relevant art.

Referring to the drawings in general, it will be understood that the illustrations are for the purpose of describing particular embodiments of the disclosure and are not intended to be limiting thereto. Drawings are not necessarily to scale and arrangements of specific units in the drawings can vary.

While most of the terms used herein will be recognizable to those of ordinary skill in the art, it should be understood, however, that when not explicitly defined, terms should be interpreted as adopting a meaning presently accepted by those of ordinary skill in the art. In cases where the construction of a term would render it meaningless or essentially meaningless, the definition should be taken from Webster's Dictionary, 11th Edition, 2008. Definitions and/or interpretations should not be incorporated from other patent applications, patents, or publications, related or not, unless specifically stated in this specification or if the incorporation is necessary for maintaining validity.

Certain terms are used in the following description and claims to refer to particular system components. As one skilled in the art will appreciate, different persons may refer to a component by different names. This document does not intend to distinguish between components that differ in name but not function. The drawing figures are not necessarily to scale. Certain features of the invention may be shown exaggerated in scale or in somewhat schematic form, and some details of conventional elements may not be shown, all in the interest of clarity and conciseness.

Although several preferred embodiments of the present invention have been described in detail herein, the invention is not limited hereto. It will be appreciated by those having ordinary skill in the art that various modifications can be made without materially departing from the novel and advantageous teachings of the invention. Accordingly, the embodiments disclosed herein are by way of example. It is to be understood that the scope of the invention is not to be limited thereby.

The present invention generally relates to a wire release mechanism 100 on a strapping machine. More particularly, some embodiments of the present invention relate to a wire release mechanism 100 coupled to a wire tying system of a strapping machine, for securing and ejecting at least one end of a wire applied to a baled material. For example, the wire release mechanism 100 may be used to secure a wire around a bale of recycled material during knotting of the wire and eject the wire after knotting is complete. As such, embodiments of the wire release mechanism are coupled to and/or adjacent to a wire tying system of a strapping machine for baling bulk material.

Figure 1B:
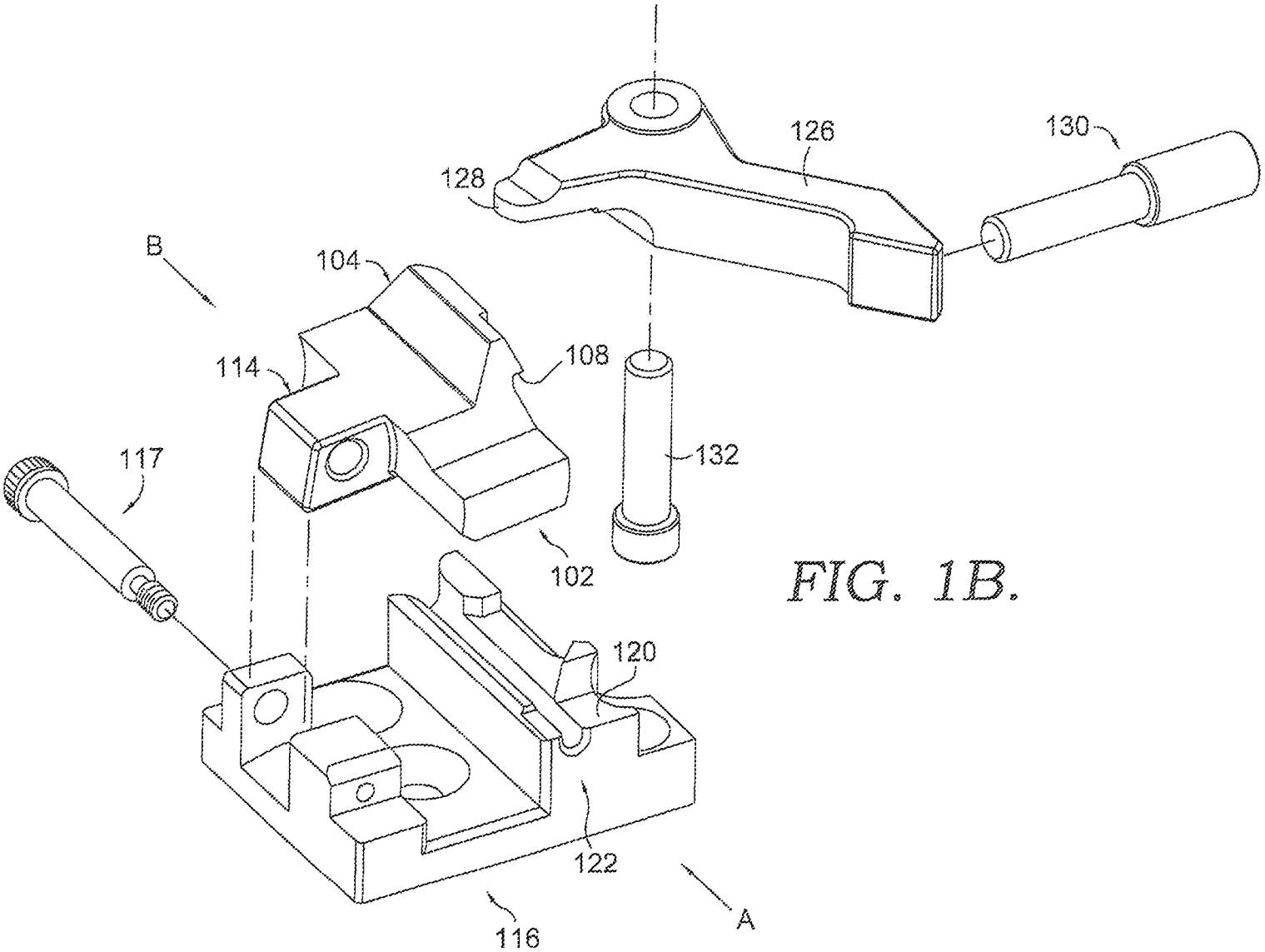
FIG. 1B is an exploded bottom view of the second end of the wire release mechanism of FIG. 1A, in accordance with an embodiment of the invention.

Referring initially to FIGS. 1A and 1B, exploded, bottom views are illustrated depicting an exemplary embodiment of a wire release mechanism 100. In some embodiments, the wire release mechanism 100 is removably coupled to at least a portion of a wire tying assembly (not shown), such as at an end of the wire tying assembly. FIGS. 1A and 1B include viewpoint A and viewpoint B illustrating opposing views of the wire release mechanism 100. Viewpoint A substantially depicts the wire release mechanism 100 from the external side of the end of the wire tying assembly (not shown) where a wire 30 is retained during tying and begins to exit the wire release mechanism 100. Additionally, viewpoint B substantially depicts the wire release mechanism 100 from the internal side of the end of the wire tying assembly (not shown), where the gripped end of the wire 30 enters the wire release mechanism 100.

In one embodiment, the illustrated wire release mechanism 100 includes a wire release portion 102 hingedly affixed to a base 116 at a pivot yoke 118 and a gripping arm 126. The base 116 may be affixed to a wire tying assembly (not shown). The wire release portion 102 may rotate about the pivot yoke 118 between the open position (see FIG. 7 for example) and the closed position (see FIG. 8 for example). The illustrated wire release portion 102 has a first portion 104 opposite a second portion 114. The first portion 104 depicted in FIGS. 1A and 1B includes a lip 108 projecting therefrom and away from the second portion 114. The exemplary lip 108 includes a first wire guide flange 110 spaced apart from an engaging surface 106 by an offset 112. In one embodiment, the first wire guide flange 110 directs at least one end of a wire to a point adjacent to the engaging surface 106. The illustrated offset 112 permits the gripping arm 126 to press a portion of at least one end of a wire against the engaging surface 106 and farther towards the second portion 114 than a portion of at least one end of a wire adjacent to the first wire guide flange (as shown in FIG. 8). In this configuration, the offset 112 corner provides additional resistance against the wire 30 being ungripped by the wire release mechanism 100, according to embodiments of the invention.

In one embodiment, the illustrated second portion 114 of the wire release portion 102 may be affixed to the base 116 at the pivot yoke 118. As understood from the bottom view perspective, the wire release portion 102 may be rotatably affixed via the pivot yoke 118 such that when not physically retained against the base 116, the wire release portion 102 drops (i.e., via gravity) into an open position. A coupling mechanism 117 (e.g., a pin structure or a hinge assembly) may secure the wire release portion 102 to the base 116, in some aspects, such that rotation at the moveably coupled pivot yoke 118 and second portion 114 permits opening and closing of the wire release mechanism 100.

Figure 2:
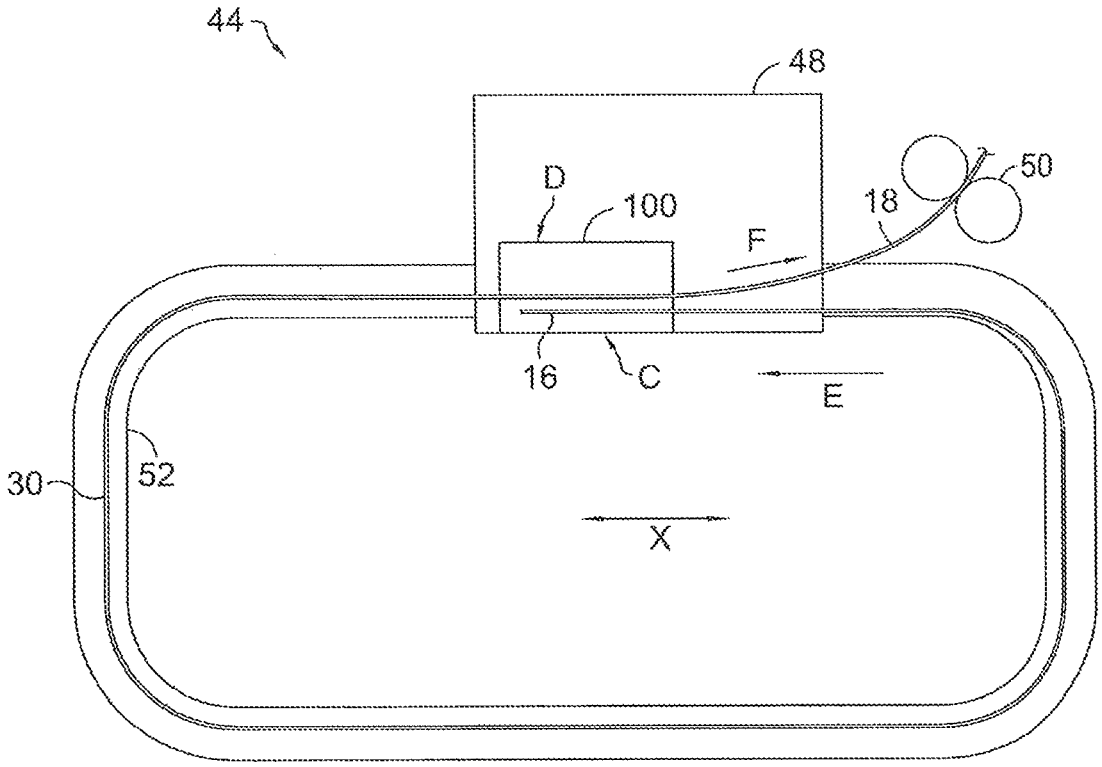
FIG. 2 is a schematic side view of an exemplary strapping machine having a wire release mechanism and a wire tying system, in accordance with an embodiment of the invention.

In several embodiments, the exemplary base 116 further comprises a wire channel 122 set inside and/or extending along a wire receiving surface 120. As the loop of wire 30 is drawn around the baling apparatus (as described below and as depicted in FIG. 2), the wire 30 initially passes the wire release mechanism 100 a first time and continues around the baling apparatus until the end of the wire 30 returns around the loop and again passes the wire release mechanism 100 to the point the wire 30 is to be gripped. The wire channel 122 receives the wire 30 as it passes the wire release mechanism 100 the first time.

In several embodiments, the illustrated base 116 further includes a second wire guide flange 124 positioned adjacent to the wire channel 122. In one embodiment of the invention, the second wire guide flange 124 directs at least one end of a wire to the point adjacent to the engaging surface 106. In some embodiments, the second wire guide flange 124 is positioned across the wire channel 122 from the first wire guide flange 110.

Figure 8:
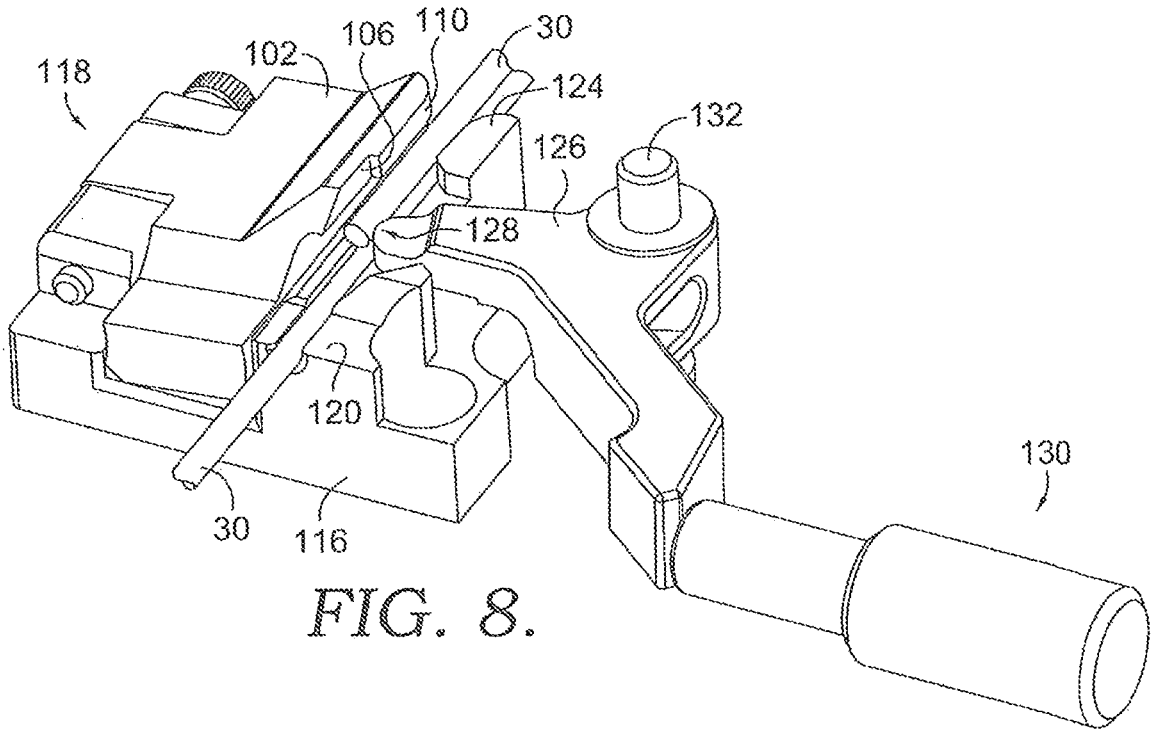
FIG. 8 is a perspective, bottom view of an exemplary wire release mechanism having a wire release portion in a closed position and a gripping arm in an open position, in accordance with an embodiment of the invention.
Figure 9:
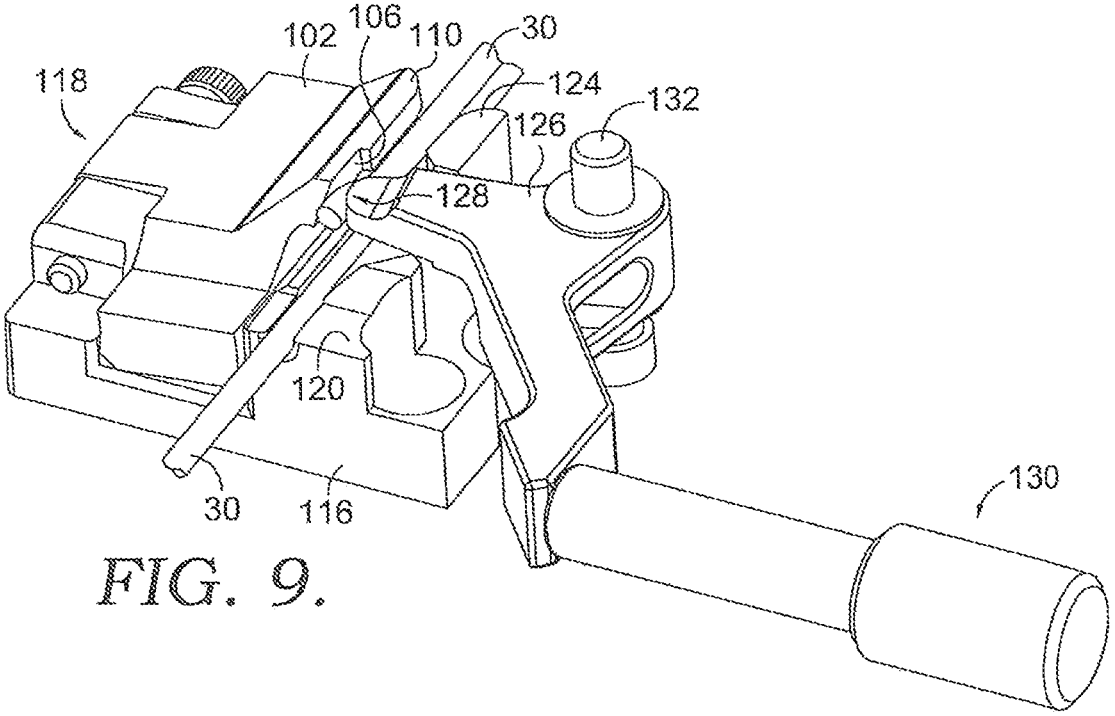
FIG. 9 is a perspective, bottom view of an exemplary wire release mechanism having a wire release portion in a closed position and a gripping arm in a closed position, in accordance with an embodiment of the invention.

In one embodiment, the gripping arm 126 may be coupled to the wire tying assembly by a pin 132 and hydraulically actuated by a hydraulic arm 130 that may rotate the gripping arm 126 around the pin 132 between the first position (e.g., FIG. 8) and the second position (e.g., FIG. 9). The hydraulic arm 130 may be coupled to a hydraulic system of the wire tying assembly and may be in fluid communication with a common hydraulic circuit that is shared with a portion of the wire tying assembly that applies a tying force to the wire 30. The common hydraulic circuit may provide hydraulic fluid to the hydraulic arm 130 such that the force applied by the hydraulic arm 130 through the gripping arm 126 to the wire 30 increases in proportion to the force applied by the portion of the knotting assembly that applies a tying force. As such, a threshold amount of force applied by the gripping arm 126 at its retractable surface 128 against at least a portion of a wire 30 positioned between the gripping arm 126 and the engaging surface 106 of the wire release portion 102, provides a threshold amount of force for the wire release mechanism 100 securing the wire 30 during wire tying.

Embodiments of the wire release mechanism 100 may be configured for use with a wire tying assembly for tying a wire strap around a baled material. The wire tying assembly may be, but is not limited to, the knotter assembly described in one or more of the following patents: U.S. Pat. Nos. 8,397,632; 9,045,245; and 8,757,055.

Additionally, the wire tying assembly used with wire release mechanism 100 may include a control system coupled directly or indirectly to the wire tying assembly. For example, a strapping machine of a wire tying system may include a common control system configured to control at least a portion of the wire tying mechanism and/or related components, such as the control system described in U.S. Application No. 61/873,662, filed Sep. 4, 2013, entitled "Control User Interface For Tying System", the disclosure of which his hereby incorporated by reference in its entirety.

As shown in the exemplary side view of FIG. 2, in some embodiments, a loop of wire 30 is formed around a baling apparatus 44, which includes a wire release mechanism 100 coupled to a wire tying assembly 48 (e.g., a knotter assembly), and a tensioning mechanism 50. In some embodiments, tensioning mechanism 50 may include any number of features for use during tensioning of a wire 30 with a wire tying system, as is shown in the example of FIG. 2 with adjacent feed wheels for illustrative purposes only. When viewed from the side, the bottom side C of the wire release mechanism 100 is facing downward, while the top side D of the wire release mechanism 100 is oriented in the opposite direction. In embodiments, during loading of the baling apparatus 44 with wire 30, the first end 16 of the wire 30 enters the track 52 of the baling apparatus 44 in the first direction E, travels around a perimeter of the track 52, and returns through the wire tying assembly 48 to the wire release mechanism 100. As such, when viewed from the bottom side C of the wire release mechanism 100 (i.e., the bottom view of FIGS. 7-10), the wire 30 is retained and/or layered within the wire release mechanism 100 such that the first end 16 is closest the bottom side C, and the second end 18 is closest the top side D. Accordingly, the wire release mechanism 100 is configured to secure the first end 16 of the wire 30 during application of tension by the tensioning mechanism 50. In some embodiments, in response to tension applied by the tensioning mechanism 50 in the second direction F, travel of the first end 16 of the wire 30 is restricted by the wire release mechanism 100.

Figure 3:
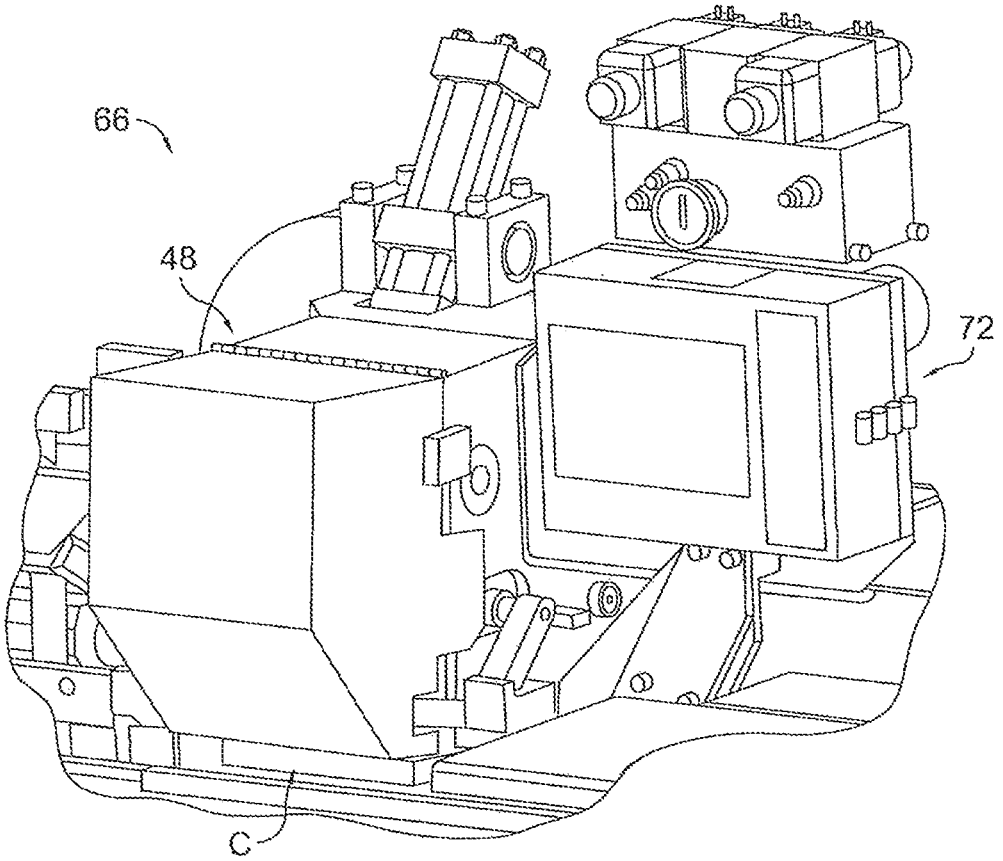
FIG. 3 is a perspective view of an exemplary wire tying system, in accordance with an embodiment of the invention.

As shown in the embodiment illustrated in FIG. 3, a wire tying system 66 may include a wire tying assembly 48 coupled to a control mechanism 72. In embodiments, the control mechanism 72 is configured to control one or more components of the wire tying system 66. In response to tying and/or knotting of the wire 30 by the wire tying assembly 48, at least a portion of the wire 30 secured by the wire release mechanism 100 may be released by the wire release mechanism 100 and/or wire tying assembly 48. In embodiments, the wire release mechanism 100 may be in contact with a wire tying assembly 48, such as a removable component including one or more wear parts of a wire tying assembly 48.

Figure 4:
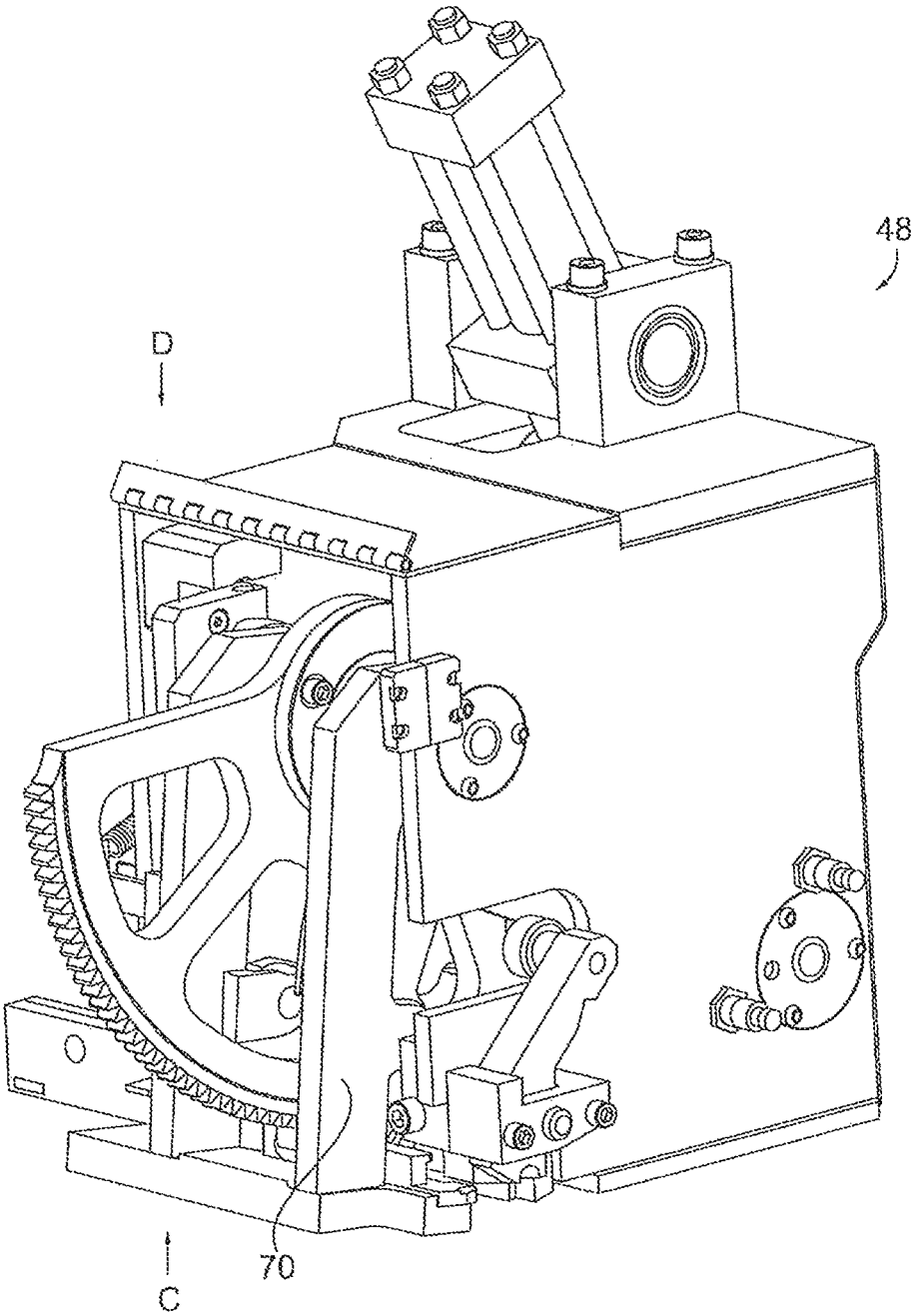
FIG. 4 is a perspective view of an exemplary wire tying assembly with the face plate removed and having a rotating arm in a rearward position, in accordance with an embodiment of the invention.
Figure 5:
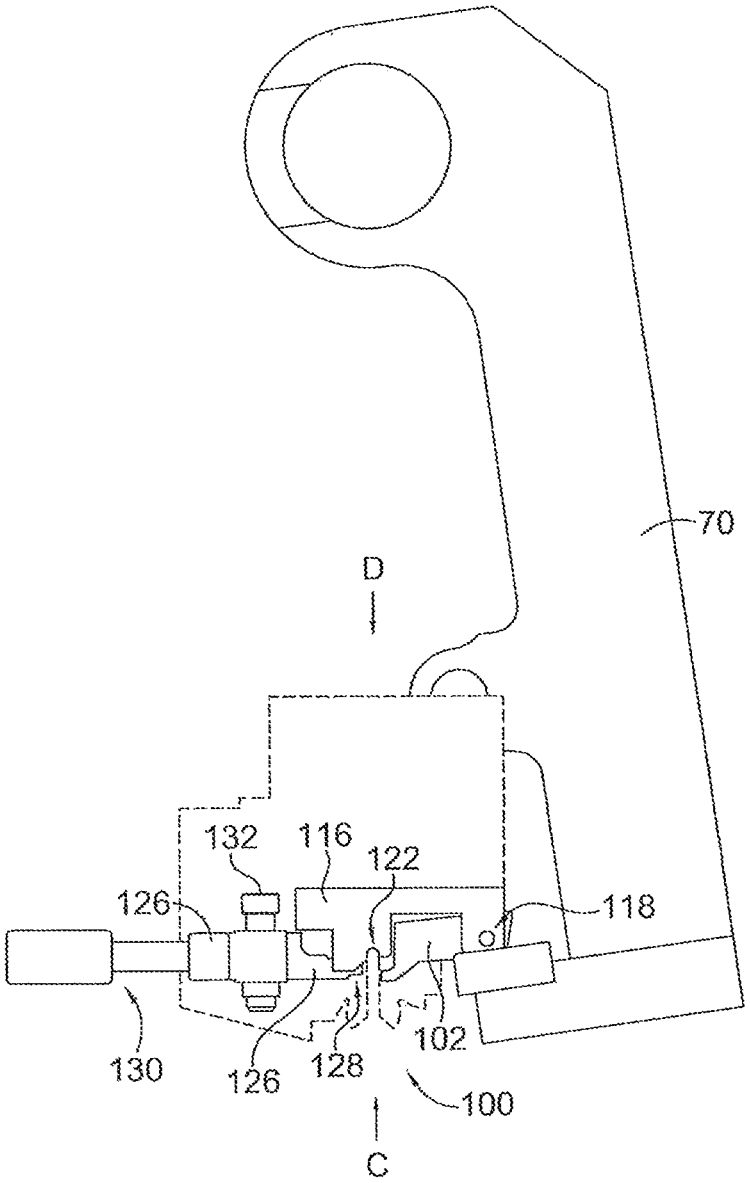
FIG. 5 is a side elevation view of an exemplary wire release mechanism having a rotating arm in a rearward arm position, a wire release portion in an open position, and a gripping arm in an open position, in accordance with an embodiment of the invention.
Figure 6:
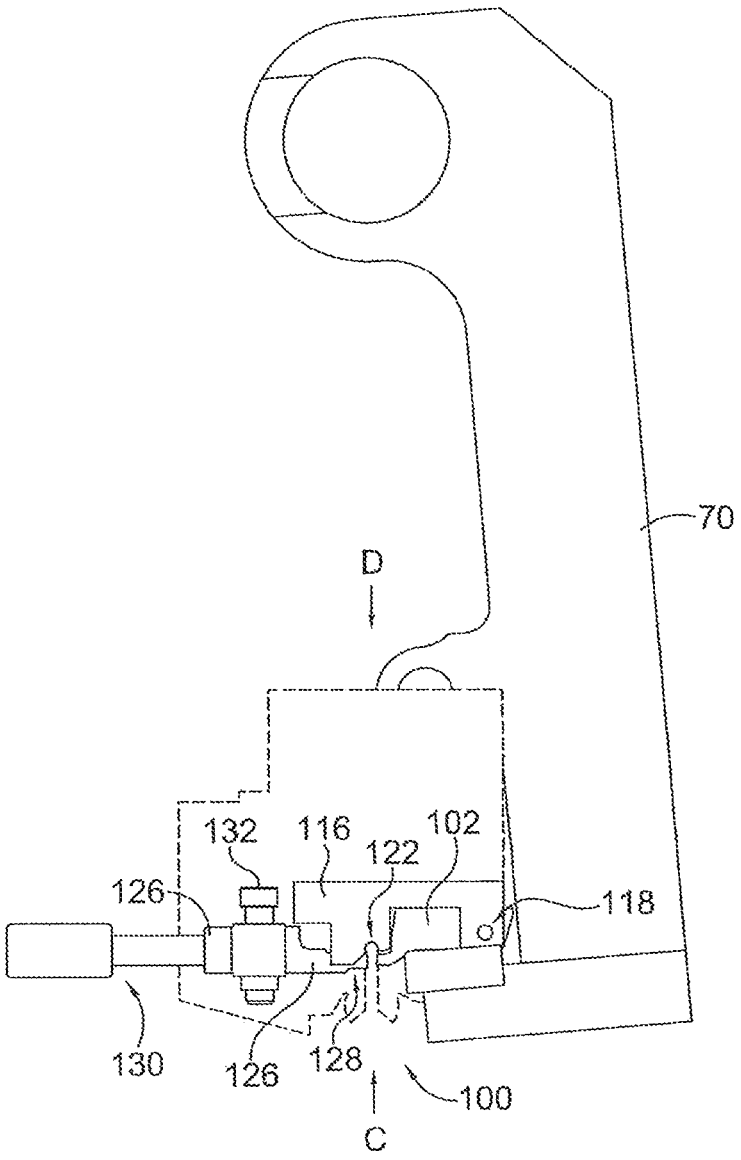
FIG. 6 is a side elevation view of an exemplary wire release mechanism having a rotating arm in a forward arm position, a wire release portion in a closed position, and a gripping arm in a closed position, in accordance with an embodiment of the invention.

In further embodiments illustrated in FIGS. 4-6, the wire release mechanism 100 may be in contact with the removable component and may be activated in response to one or more parts of the wire tying assembly 48, such as by contact with at least a portion of the rotating arm 70 of the wire tying system. As depicted in FIG. 4, one embodiment of the wire tying assembly 48 comprising a knotter assembly is illustrated having its face plate removed to expose the internal components of the knotter assembly. One of the internal components of the illustrated embodiment includes the rotating arm 70. The rotating arm 70 is depicted in the rearward arm position. The wire release mechanism 100 is not shown in FIG. 4 because it is positioned on the bottom side C and cannot be seen in the illustrated perspective.

In some embodiments, the rotating arm 70 may be moved between the rearward arm position (as illustrated in FIG. 5) and a forward arm position (as illustrated in FIG. 6). For example, FIG. 5 illustrates a side view of one embodiment of the present invention and depicts the rotating arm 70 in the rearward arm position and the wire release portion 102 in the open position. Further depicted is the gripping arm 126 in the first position and the hydraulic arm 130 in a retracted position. In the illustrated embodiment, the rotating arm 70 is positioned adjacent to the wire release portion 102, but is not mechanically coupled to the wire release portion 102. Hence, in the illustrated embodiment where the wire release mechanism 100 is positioned on bottom side C and the rotating arm 70 hinges from top side D, the wire release portion 102 may fall to the open position by gravity when the rotating arm 70 is moved to the rearward arm position.

FIG. 6 illustrates a side view of one embodiment of the present invention and depicts the rotating arm 70 in the forward position and the wire release portion 102 in the closed position. Also depicted is the gripping arm 126 in the first position and the hydraulic arm 130 in an extended position. In the illustrated embodiment, the rotating arm 70 is positioned adjacent to the wire release portion 102, but is not mechanically coupled to the wire release portion 102. Hence, in the illustrated embodiment where, the wire release mechanism 100 is positioned on bottom side C and the rotating arm 70 hinges from top side D, the wire release portion 102 may be pressed from bottom side C towards top side D by the rotating arm 70 when the rotating arm 70 is moved to the forward arm position.

Figure 7:
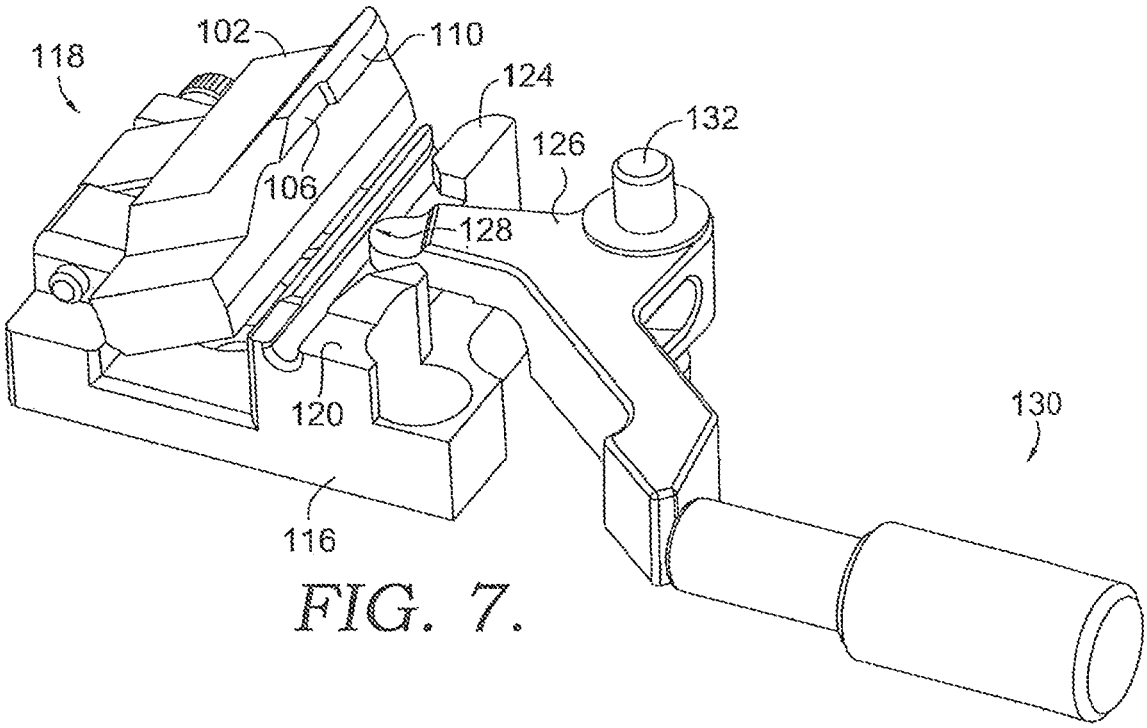
FIG. 7 is a perspective, bottom view of an exemplary wire release mechanism having a wire release portion in an open position and a gripping arm in an open position, in accordance with an embodiment of the invention.

In some embodiments, the positioning of the wire release mechanism 100 during an exemplary wire tying cycle is described in reference to FIGS. 7-10. An exemplary wire tying cycle may include the steps of moving the retractable surface 128 to the first position (as illustrated in FIG. 7) and moving the wire release portion 102 to the closed position (as illustrated in FIG. 8). The wire release portion 102 may be moved into the closed position of exemplary FIG. 8 based on one or more forces applied by one or more features of a wire tying system. For example, a rotating arm 70 may be mechanically coupled to the wire release portion 102, such that when the rotating arm 70 moves between the forward arm position and the rearward arm position, the mechanical coupling forces the wire release portion 102 to move between the closed position and open position. In another aspect, the rotating arm 70 may be positioned adjacent to the wire release portion 102, such that when the rotating arm 70 moves from the rearward arm position to the forward arm position, the rotating arm 70 contacts the wire release portion 102 and moves the wire release portion 102 to the closed position. Similarly, in one aspect, when the rotating arm 70 moves from the forward arm position to the rearward arm position, the contacted wire release portion 102 may be allowed to move to the open position. The contacted wire release portion 102 may move to the open position by mechanical coupling, by gravity, or by another means.

In further aspects of the wire tying cycle, a wire 30 provided through the track 52 of a wire tying apparatus is carried along the track 52 (as depicted in FIG. 2) and advanced into the wire channel 122, looped around the track 52, and back between the first wire guide flange 110 and second wire guide flange 124 to the point adjacent to the engaging surface 106 of FIG. 9.

In further aspects of the wire tying cycle, the gripping arm 126 is moved to the second position, as illustrated in FIG. 9, to secure at least one end of a wire between the retractable surface 128 and the engaging surface 106. These aspects are further illustrated in FIG. 6 where a rotating arm 70 is moved to a forward arm position, which thereby holds the adjacent wire release portion 102 in the closed position and the retractable surface 128 is extended to the second position to engage the wire 30 (not shown). In one aspect, the retractable surface 128 engages the wire 30 when the gripping arm is moved to the second position. In one embodiment, the hydraulic arm 130 extends to move the gripping arm 126 into the second position. Once the wire 30 is gripped, by the wire release mechanism 100, the wire 30 is tied by the wire tying assembly 48.

Figure 10:
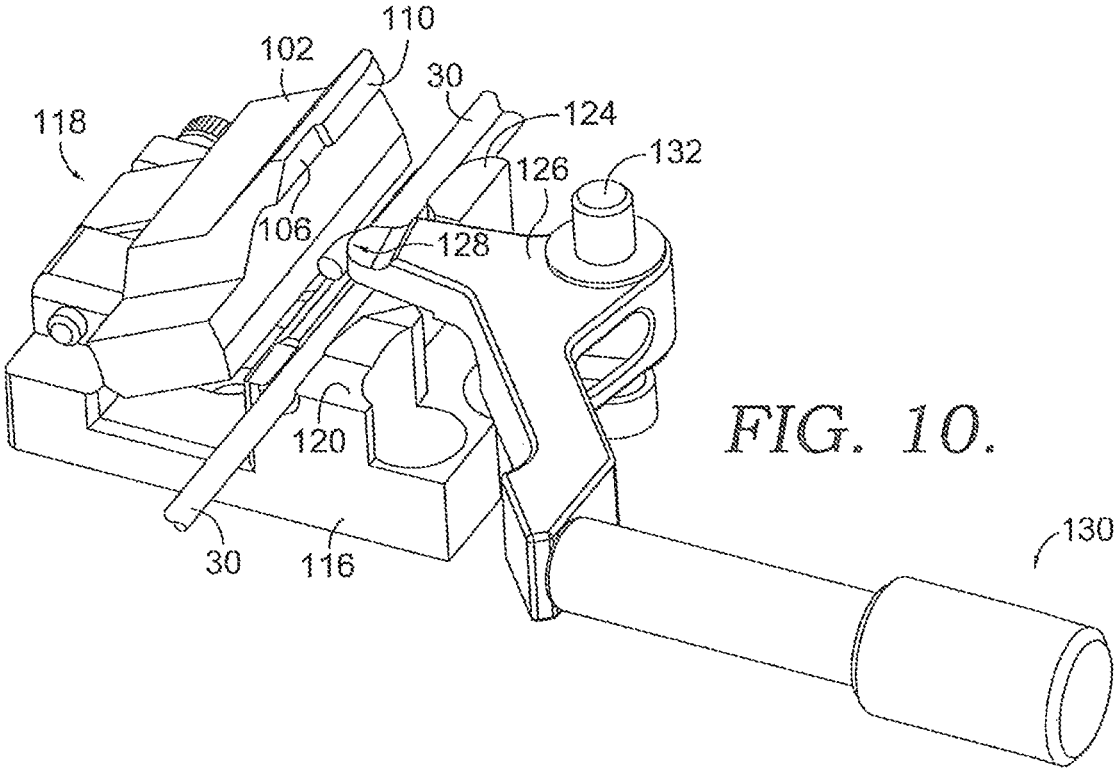
FIG. 10 is a perspective, bottom view of an exemplary wire release mechanism having a wire release portion in an open position and a gripping arm in a closed position, in accordance with an embodiment of the invention.

In further aspects of the wire tying cycle, and as further illustrated in the example of FIG. 10, after the wire 30 secured by the wire release portion 102 and the gripping arm 126 of the wire release mechanism 100 has been tied by the wire tying assembly 48, the wire release portion 102 may be moved to the open position to release/eject at least one end of a wire 30. Such open position of the wire release portion 102 in this configuration may correspond to one or more positions of the wire tying assembly 48, such as the rearward arm position. By the wire release portion 102 moving from the closed position (FIGS. 8 and 9) to the open position (FIG. 10), the wire 30 is released by the wire release mechanism 100, and the engaging surface 106 and the retractable surface 128 are disengaged from the wire 30 once a wire tying cycle is completed.

As described above, in some embodiments, several of the components included herein, such as the base 116, the gripping arm 126, the retractable surface 128, and the hydraulic arm 130, may be integrated within, or associated with, one or more features of a wire tying assembly 48. In such embodiments, wire tying cycles similar to the exemplary wire tying cycle described above are contemplated where the non-integrated components of the wire release mechanism 100 work in concert with the integrated components in the wire tying assembly.

From the foregoing, it will be seen that this invention is one well adapted to attain all the ends and objects hereinabove set forth, together with other advantages, which are obvious and inherent to the structure, it will be understood that certain features and subcombinations are of utility and may be employed without reference to other features and subcombinations. This is contemplated by and is within the scope of the claims. Since many possible embodiments may be made of the invention without departing from the scope thereof, it is to be understood that all matter herein set forth or shown in the accompanying drawings is to be interpreted as illustrative and not in a limiting sense.

I claim:

1. A wire release system comprising:

a wire release mechanism comprising;

a wire release portion rotatable about pivot yoke between an open position and closed position;

said wire release portion further comprising a first portion opposite a second portion;

said first portion further comprising a lip projecting away from said second portion;

said lip further comprising a first wire guide flange spaced apart from an engaging surface by an offset spaced between a gripping arm designed to press a portion of a wire against said engaging surface and towards said second portion;

a wire tying assembly comprising;

a pin; and a hydraulic arm; wherein said wire release mechanism is in structural communication with said wire tying assembly; and said gripping arm is coupled to said wire release mechanism by said pin and hydraulically actuated by said hydraulic arm to rotate said gripping arm around said pin between a first open position and a second closed position.

2. The wire release system of claim 1 further comprising:

a base;

said wire release portion is affixed to said base at said pivot yoke.

3. The wire release system of claim 2 further comprising:

a coupling mechanism designed to secure said wire release portion attached to said base.

4. The wire release system of claim 2 further comprising:

said base further comprises a wire channel set interior to said base extending along a wire receiving surface.

5. The wire release system of claim 1 further comprising:

a hydraulic system on said wire tying assembly; wherein said hydraulic arm is coupled to said hydraulic system of said wire tying assembly.

6. A method of completing a wire tying cycle comprising the steps of:

moving a wire release portion into a closed position;

advancing a wire with an end;

gripping said end of said wire by pressing the wire against an engaging surface with a retractable surface of a wire tying assembly with a gripping arm that is actuated by a hydraulic arm;

tying said wire, and moving said wire release portion to an open position to release said end of said wire.

7. A wire release system for securing at least one end of a wire during a wire tying cycle of a wire tying assembly comprising:

a wire release mechanism comprising;

a wire release portion having an engaging surface;

said wire release portion is affixed to a wire tying assembly such that said wire release portion can move between either an open position where said engaging surface is disengaged from, and a first distance away from, an end of a wire, or a closed position where the engaging surface may engage, and is a second distance away from, said end of said wire during the wire tying cycle; and a gripping arm with a retractable surface;

said gripping arm further being affixed to said wire release mechanism such that the gripping arm is configured to move between a first position where said retractable surface is disengaged from a wire and a second position where said retractable surface may engage the wire during the wire tying cycle.

8. The wire release system of claim 7 further comprising:

a base; wherein said wire release portion is affixed to said base such that said wire release portion can move between an open position relative to said base and a closed position relative to said base during a wire tying cycle.

9. The wire release system of claim 8 further comprising:

said base further comprises a wire receiving surface with a wire channel positioned on the wire receiving surface such that the engaging surface is located adjacent to the wire channel when the wire release portion is in the closed position.

10. The wire release system of claim 9 further comprising:

a lip positioned adjacent to the wire-channel when the wire release portion is in the closed position.

11. The wire release system of claim 9 further comprising:

said wire receiving surface further comprises a first wire guide flange and a second wire guide flange.

12. The wire release system of claim 7 further comprising:

said wire release portion comprises a first portion with said engaging face.

13. The wire release system of claim 12 further comprising:

said wire release portion comprises a lip projecting therefrom and away from said second portion positioned opposite said first portion on said face.

14. The wire release system of claim 13 further comprising:

said lip further comprises a first wire flange guide for directing said wire past the engaging surface.

* * * * *